United States Patent [19]

Brady

[11] 4,003,168

[45] Jan. 18, 1977

[54] CRANE BOOM OF TRAPEZOIDAL BOOM SECTIONS HAVING REINFORCING RINGS

[75] Inventor: Rupert J. Brady, Bethesda, Md.

[73] Assignee: Walter Kidde & Company, Inc., Clifton, N.J.

[22] Filed: June 27, 1975

[21] Appl. No.: 590,854

[52] U.S. Cl. ..... 52/118; 52/731; D12/57; D12/60

[51] Int. Cl.[2] ..... B66T 11/00; E04H 12/34

[58] Field of Search ..... 52/115, 118, 117, 731, 52/634, 636; 212/55; D12/57, 60

[56] References Cited

UNITED STATES PATENTS

| | | | |
|---|---|---|---|
| 1,052,207 | 2/1913 | Beckman | 52/731 |
| 1,552,474 | 9/1925 | Dornier | 52/634 |
| 1,656,871 | 1/1928 | Schnitzer | 52/731 X |
| 1,682,202 | 8/1928 | Vaughn | 52/636 |
| 1,994,716 | 3/1935 | Klemperer | 52/731 X |
| 3,283,464 | 11/1966 | Litzka | 52/636 |
| 3,423,890 | 1/1969 | Leigh | 52/118 |
| 3,587,886 | 6/1971 | Gano et al. | 52/118 X |
| 3,708,937 | 1/1973 | Sterner | 52/115 X |
| 3,736,710 | 6/1973 | Sterner | 52/115 |
| 3,807,108 | 4/1974 | Johnston | 52/115 |
| 3,890,757 | 6/1975 | Lamer et al. | 52/118 X |
| D224,128 | 7/1972 | Sterner | D12/60 |
| D224,129 | 7/1972 | Sterner | D12/60 |
| D224,978 | 10/1972 | Sterner | D12/60 |
| D224,979 | 10/1972 | Sterner | D12/60 |
| D236,966 | 9/1975 | Gardenhour | D12/60 |

FOREIGN PATENTS OR APPLICATIONS

| | | | |
|---|---|---|---|
| 1,009,373 | 5/1957 | Germany | 212/55 |
| 580,549 | 9/1946 | United Kingdom | 52/634 |

*Primary Examiner*—Price C. Faw, Jr.
*Assistant Examiner*—Leslie Braun
*Attorney, Agent, or Firm*—Brady, O'Boyle & Gates

[57] ABSTRACT

To reduce the weight of a construction crane boom without materially lessening the lifting capacity thereof where the boom sections have an inverted trapezoidal cross sectional shape, a series of openings is formed in the two side plates of each boom section and such openings are provided with internal reinforcing rings or braces. The bottoms of the reinforcing rings are arranged in stress-transferring relation to the boom section side plates and adjacent longitudinal vertical reinforcing plates or stiffeners provided in the structure. Cooperating side plate brace bars arranged between the reinforced side plate openings have their lower ends attached to the longitudinal side plate stiffeners.

5 Claims, 7 Drawing Figures

CRANE BOOM OF TRAPEZOIDAL BOOM SECTIONS HAVING REINFORCING RINGS

CROSS-REFERENCE TO RELATED APPLICATION

This application contains subject matter in common with design patent application Ser. No. D-478,150, filed June 10, 1974, for BOOM SECTION FOR A CANTILEVERED CRANE BOOM, now U.S. Pat. No. D-236,964, dated Sept. 30, 1975, and assigned to the same Assignee as the instant application.

BACKGROUND OF THE INVENTION

The demands of the construction industry for cranes of ever-increasing load lifting capacity have taxed the capabilities of crane manufacturers to satisfy these demands with existing materials to the utmost.

Recently, crane booms of increased efficiency and lifting capacity have been created including telescoping booms which are trapezoidal in cross section, and also possessing the cross sectional form of an inverted trapezoid or A-frame. While these efficient geometric shapes have resulted in a significant lifting strength to boom weight ratio increase, nevertheless the need for still greater lifting capacity exists, preferably without significantly increasing the size and weight of the boom itself, which obviously can defeat the purpose or objective of the construction.

It has been proposed in the prior art to provide openings in the side walls of beams, girders and crane booms for the overall purpose of reducing their weights while maintaining sufficient load-bearing capacity. However, in connection with the larger types of construction cranes now being employed, the weight advantage gain by the formation of openings in boom section side walls can be more than offset by the resulting loss in resistance to buckling of the side walls under loading, so that the net result can be a loss in the load lifting capacity of the crane boom, unless the side walls or plates are increased in thickness or otherwise braced which, again, can defeat the weight saving purpose of the side wall openings. As a consequence, the construction crane industry continues to seek solutions to the continuing problem caused by the ever increasing demand for crane booms of greater load lifting ability.

The present invention seeks to provide a solution to this problem or need in the art, particularly in connection with one recent form of boom or boom section, as disclosed in U.S. Pat. No. 3,807,108, issued Apr. 30, 1974. This patent discloses a hydraulically operated telescoping crane boom whose interfitting boom sections have the cross sectional shape of an inverted trapezoid or A-frame. The patent discloses for at least some of the boom sections continuous longitudinal side plate stiffeners in the form of vertical plate elements having their upper and lower longitudinal edges attached, respectively, to the boom section side plates and bottom plates adjacent the side edges of the latter. The stiffeners are of much lesser depth than the main side plates of the boom section and their purpose is to increase the buckling strength of the side plates significantly.

The present invention or improvements take advantage of the construction disclosed in the aforementioned patent in such a way as to render it possible and practical to provide large side plate openings along the length of a boom section or sections without increasing the thickness of the side plates and in many instances enabling the side plate thickness to be reduced and without reducing their resistance to buckling under load. Therefore, the invention has for its main object to improve upon the boom or boom section disclosed in U.S. Pat. No. 3,807,108 by the use of additional means having a direct cooperative relationship with the side wall stiffening means shown in the patent.

More particularly, in the present invention, an inverted trapezoidal boom section having the continuous longitudinal side wall stiffeners or reinforcing plates disclosed in said patent is additionally provided with a series of side plate or side wall apertures, whose presence eliminates large sections of metal from the side plates and thus greatly reduces the weight of the boom section. Reinforcing stress transmitting rings are positioned in the side plate openings so as to project inwardly and outwardly of the side plates, and the bottoms of these rings are positioned in stress transferring relationship with both the boom section side plates and the longitudinal vertical stiffeners for the side plates which are also joined to the boom section bottom plate at the longitudinal edges thereof. As a result, stresses which tend to buckle the side plates of the boom section and which are normally transmitted diagonally from top to bottom are now enabled to be transmitted around the side plate opening reinforcing rings to the mentioned side plate stiffeners and adjacent lower portions of the side plates. These coacting elements provide the effect of multiple columns along the opposite side walls of the boom section providing great resistance to buckling. Cooperating top to bottom brace bars on the boom section side plates between the several openings and reinforcing rings further resist buckling and these brace bars also have their lower ends attached to the longitudinal stiffeners for the side plates immediately below said rings. The total result of the invention is a significant reduction in the weight of the boom or boom section for a given size and load lifting capacity. Therefore, it becomes feasible and practical with existing materials to meet the needs of the industry. More particularly, by means of the invention, the side plates of an inverted trapezoidal boom section may be materially reduced in weight while maintaining adequate resistance to buckling under loads of a magnitude which it is required to lift in a given crane boom size or design.

Other features and advantages of the invention will become apparent during the course of the following description.

BRIEF DESCRIPTION OF DRAWING FIGURES

DETAILED DESCRIPTION

Figure 1:
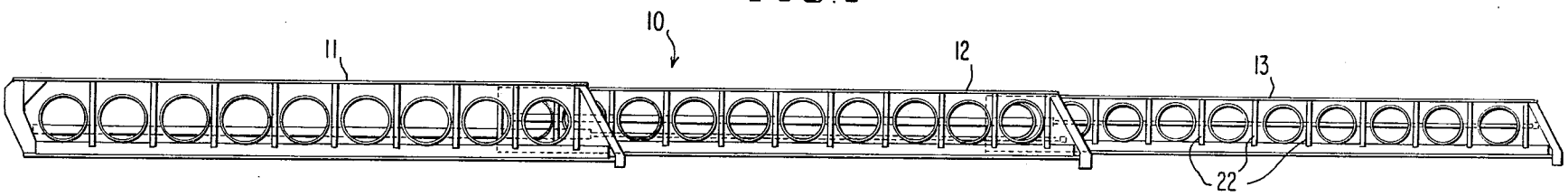
FIG. 1 is a partly schematic side elevation of a telescoping crane boom whose individual boom sections embody the present invention.

Referring to the drawings in detail, wherein like numerals designate like parts, a hydraulically operated crane boom 10 is depicted in FIG. 1 including a base section 11, mid section 12 and an outer or fly section 13. In terms of the present invention, the number of telescoping boom sections employed in the boom is immaterial.

Figure 2:
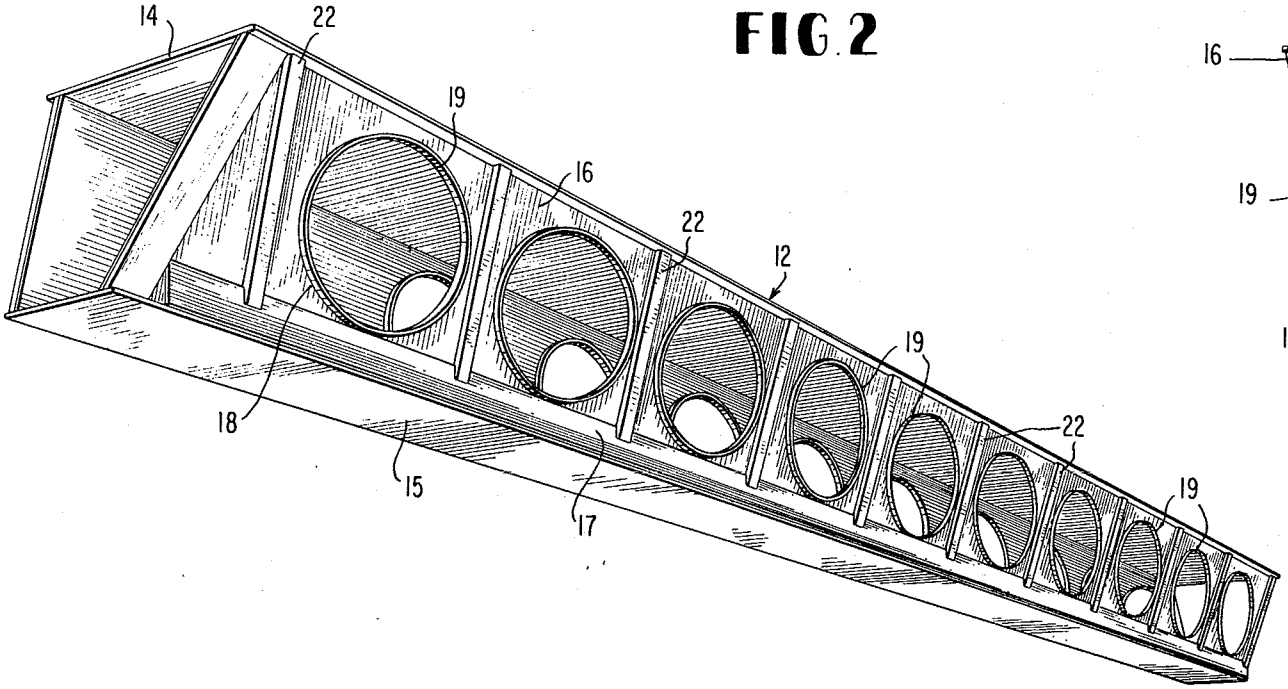
FIG. 2 is a perspective view of a single boom section embodying the invention.

FIG. 2 depicts a single boom section having the invention incorporated therein such as the mid section 12 of the boom 10 shown in FIG. 1. Substantially as disclosed in U.S. Pat. No. 3,807,108, the boom section 12 has the cross sectional shape of an inverted trapezoid including a flat relatively wide continuous top plate 14, a parallel flat relatively narrow continuous bottom plate 15, and a pair of downwardly converging opposing flat side plates 16. These plate elements are all formed of high tensile strength steel and are joined together rigidly by welding in accordance with well known practice, with the angle between the side plates 16 and the relatively narrow bottom plate 15 being greater than 90° but less than 120° approximately. For the purposes and advantages specified in the aforementioned patent, a pair of continuous longitudinal vertical stiffeners 17 are provided on the opposite sides of the boom section near the bottom plate 15 and extending somewhat thereabove and immediately outwardly of the lower extremities 16' of side plates 16. The lower edges of stiffeners 17 are welded to the longitudinal edges of bottom plate 15, as described in said patent, and their upper edges are similarly welded to the outer faces of side plates 16 above the level of the bottom plate, approximately as shown. The stiffeners 17 are continuous along the length of the boom section on both sides thereof and substantially coextensive with the inclined side plates 16.

Figure 3:
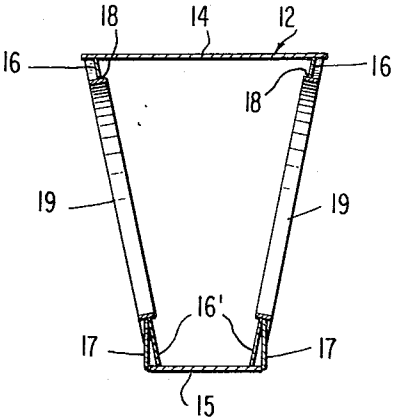
FIG. 3 is a transverse vertical cross section taken through the boom section of FIG. 2.
Figure 4:
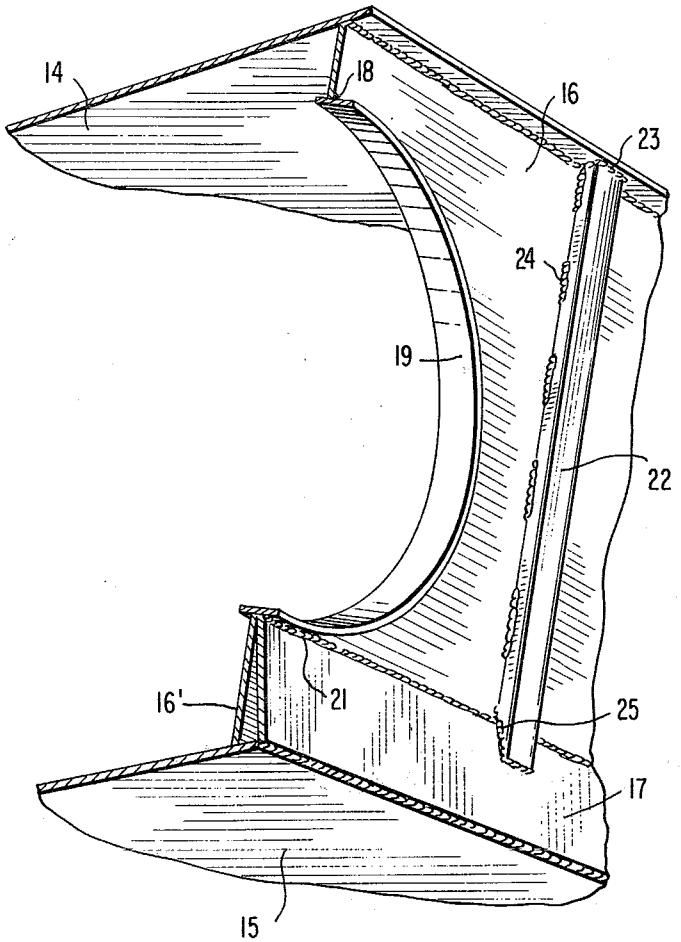
FIG. 4 is an enlarged fragmentary perspective view, partly in section, showing details of construction present in the boom section of FIG. 2.

At a plurality of equidistantly spaced points along the boom section 12, the two side plates 16 are provided with large preferably circular equal size openings 18 resulting in the removal of corresponding numbers of heavy metal sections from both side plates 16, thus materially reducing the weight of the boom. To reinforce the structure, corresponding numbers of ring elements 19 are arranged within the openings 18 preferably welded therein by substantially continuous lines of welding 20. The ring elements 19 preferably project somewhat inwardly and outwardly of the side plates 16 on which they are mounted as shown clearly in FIGS. 3 and 4, and at substantially right angles therewith.

Figure 5:
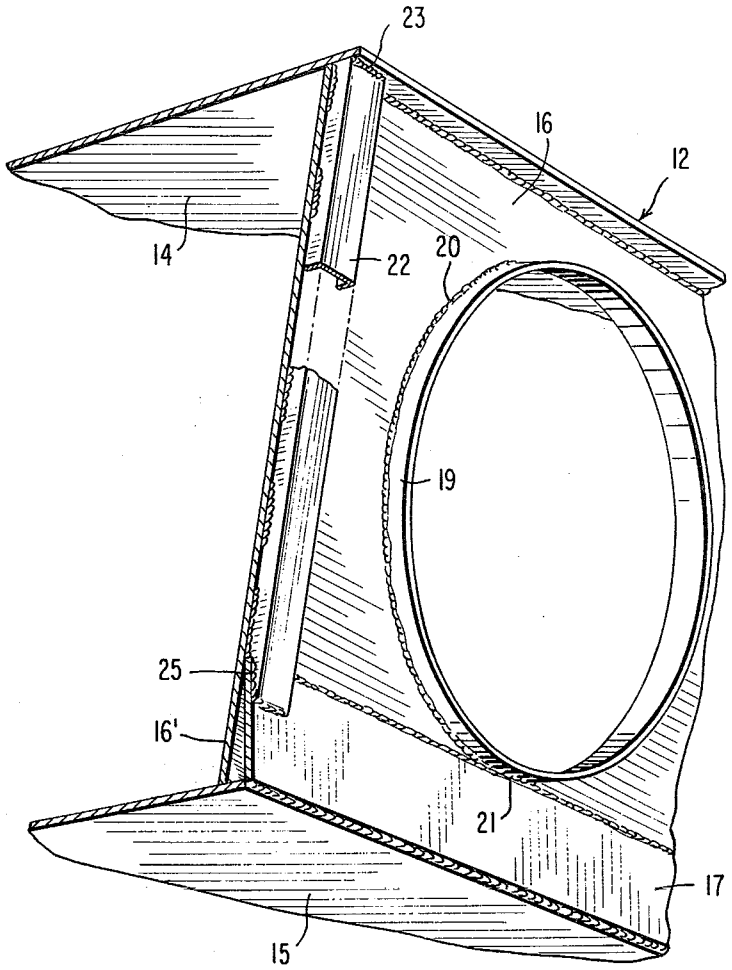
FIG. 5 is a further fragmentary perspective view, partly in cross section, similar to FIG. 4, showing additional details of construction.

The bottoms of the several ring elements 19 rest upon the top longitudinal edges of the side plate stiffeners 17 in substantially tangential relation thereto, as shown, as well as resting on the lower portions 16' of the side plates 16. The bottoms of the ring elements are additionally welded as at 21, FIG. 5, to the top edges of stiffeners 17. In this manner, the reinforcing ring elements are substantially integrated with the side plate structure of the boom section to provide compensating column support at each area along the two side plates where material has been removed in the formation of the openings 18. The functioning of the ring elements 19 in transmitting stresses will be further discussed.

In direct cooperative relationship with the reinforcing ring elements 19, a plurality of equidistantly spaced preferably channel-shaped top-to-bottom extending brace bars 22 are provided in parallel relation on the exterior of the two side plates 16. These channel cross section brace bars are intervened between the ring elements 19 symmetrically, as shown in the drawings, and their tops are welded as at 23 to the top plate 14. The opposite sides of the brace bars 22 are welded at 24 to the side plates. The lower ends of the brace bars are notched at 25 so that these ends may lap the exterior faces of side wall stiffeners 17 and the brace bars are additionally welded to the stiffeners 17 at their lower ends and around the margins of the notches 25 to produce an integrated structure. The brace bars 22 afford additional column supports on opposite sides of the boom section 12 to compensate for the removal of metal in the large openings 18 and the reduction in side wall thickness when appropriate, and to render the side plates 16 further resistant to buckling under loading. The resulting structure is much lighter than would be the case if the openings 18 were not provided, and the load lifting ability of the boom according to the invention remains excellent even in the materially lightened form.

It is emphasized that the two forms of reinforcing stress transmitting elements 19 and 22 are both structurally tied to the side plate stiffeners 17, which elements continue to function as disclosed in U.S. Pat. No. 3,807,108 to increase the buckling resistance of the boom section side plates. The elements 17 do this by reducing the unreinforced heights of the slanting side plates in the inverted trapezoidal boom section.

The operation or functioning of the improved structure may be described in the following terms. Ordinarily, stresses on the boom section side plates 16 are transmitted between the top and bottom plates 14 and 15 in a top-to-bottom direction, in the absence of the openings 18 and ring elements 19 and also in the absence of the reinforcing or brace bars 22. When the bars 22 are present, without the openings 18 or ring elements, some stresses are transmitted through the side plates 16 diagonally or from the tops of adjacent bars 22 to the bottoms thereof in intersecting diagonal directions. However, when the openings 18 are provided and the reinforcing rings 19 are in place, as described, these diagonal stresses as well as other stresses which intersect the ring elements will be transmitted downwardly through the ring elements 19 to the side plate stiffeners 17 which are in stress-receiving engagement with the ring elements as well as with the braces 22 and the side plates 16 themselves. Conversely, the ring elements 19 are in stress-transferring relation with both the side plates 16 and the side plate stiffeners 17, as the ring elements rest on both of these members as clearly depicted in FIGS. 3 and 4. The cooperative action of the ring elements 19 and braces 22 with the remaining metal of the side plates 16 and the integrated lower longitudinal stiffeners 17 renders the boom section highly resistant to buckling in its side walls due to a unique column effect afforded by the ring elements in concert with the brace bars 22. All of this is achieved with a very substantial reduction in the weight of the structure as compared, for example, to the solid side plates of the prior art evidenced by Patent 3,807,108.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In a crane boom, a boom section having top, bottom and side plates structurally joined to provide a boom section having a cross sectional form of an inverted trapezoid; continuous, longitudinally extending side plate stiffeners joined to said bottom plate and side plates and being substantially vertical and extending for a portion only of the height of the side plates, relatively large openings in the side plates at spaced points therealong and located above said stiffeners in close proximity to the top longitudinal edges of the stiffeners, and reinforcing ring elements positioned within said openings and being joined to said side plates around the peripheral edge of said openings, the outer peripheral surface of the bottom of said ring elements substantially resting on the top edges of the stiffeners and being structurally joined thereto, whereby stresses on the boom section are transmitted diagonally from the top plate to the side plate, circumferentially around the ring to the side plate stiffeners.

2. The structure of claim 1, and said ring elements extending somewhat outwardly and inwardly of said side plates, whereby their bottoms are supported conjointly by the side plates and said stiffeners.

3. The structure of claim 1, and said ring elements welded around their peripheries to said side plates and additionally welded to the top edges of said stiffeners.

4. In a crane boom according to claim 1, wherein cooperative top-to-bottom extending side plate braces are structurally joined to said side plates in intervening relation with said openings and ring elements, and having their lower ends structurally joined to said side plate stiffeners.

5. The structure of claim 4, and said braces comprising channel bars welded to the exterior faces of the side plates and having their lower ends notched to receive the tops of said stiffeners and being welded to the stiffeners at the margins of the notches.

* * * * *